US007141125B2

(12) United States Patent
McKechnie et al.

(10) Patent No.: US 7,141,125 B2
(45) Date of Patent: Nov. 28, 2006

(54) PHOTOCATALYTIC COMPOSITION

(75) Inventors: Malcolm Tom McKechnie, Hull (GB); Duncan Roger Harper, Nottingham (GB); Neil Campbell Muir, Hull (GB)

(73) Assignee: Reckitt Benckiser (UK) Limited, Slough (GB)

( * ) Notice: Subject to any disclaimer, the term of this patent is extended or adjusted under 35 U.S.C. 154(b) by 357 days.

(21) Appl. No.: 10/481,668

(22) PCT Filed: Jun. 27, 2002

(86) PCT No.: PCT/GB02/02973

§ 371 (c)(1),
(2), (4) Date: Dec. 18, 2003

(87) PCT Pub. No.: WO03/002702

PCT Pub. Date: Jan. 9, 2003

(65) Prior Publication Data

US 2004/0198625 A1 Oct. 7, 2004

(30) Foreign Application Priority Data

Jun. 28, 2001 (GB) ..... 0115832.8

(51) Int. Cl.
*C11D 3/395* (2006.01)

(52) U.S. Cl. ..... 134/42; 510/372

(58) Field of Classification Search ..... None
See application file for complete search history.

(56) References Cited

U.S. PATENT DOCUMENTS 4,189,396 A 2/1980 Brace et al. ..... 252/99

FOREIGN PATENT DOCUMENTS

| | | |
|---|---|---|
| FR | 2 729 673 | 7/1996 |
| GB | 1 600 993 | 10/1981 |
| GB | 2 358 638 A | 8/2001 |
| WO | WO 98/32829 | 7/1998 |
| WO | WO 01/46367 A1 | 6/2001 |

OTHER PUBLICATIONS

E. Yesodharan et al., Helvetica Chimica Acta 1983, vol. 66, pp. 2145-2153. No month available.*
GB 0115832.8 Search Report dated Dec. 14, 2001.

* cited by examiner

*Primary Examiner*—John R. Hardee
(74) *Attorney, Agent, or Firm*—Norris McLaughlin & Marcus PA

(57) ABSTRACT

Cleaning compositions including a photocatalytic material and a sensitiser employ a photocatalytic material and a sensitiser at a locus, for example on a surface. The residue combats soils and/or undesired microorganisms at the locus. The photocatalytic material is peroxo modified titania, preferably in its anatase form, or peroxo modified titanic acid, or a mixture thereof. The compositions are preferably alkaline.

16 Claims, No Drawings

PHOTOCATALYTIC COMPOSITION

The present invention relates to photocatalytic compositions and in particular, but not exclusively, to photocatalytic cleaning compositions, intended to reduce the frequency and/or effort of cleaning; and to methods employing such compositions. References will be made herein to cleaning compositions and/or to compositions which are effective in combating malodours and/or soils and/or microorganisms, these being preferred compositions, but descriptions and definitions which follow are applicable also to compositions intended for other purposes.

Cleaning compositions of the invention are of particular interest for cleaning surfaces such as ceramic tiles, sinks, baths, washbasins, toilets, work surfaces, ovens, hobs, carpets, fabrics, floors, painted woodwork, metalwork, laminates, glass surfaces and the like.

Cleaning compositions intended for general and for specific uses are well known in the art. Such compositions, when liquid, will commonly comprise one or more surfactants, to loosen and/or disperse oily deposits and to dissolve water soluble materials. These cleaning compositions may include one or more of solvents (including water), thickening agents, abrasive particles, bleaching agents, disinfectants/antibacterial agents, perfumes, waxes or other polishing agents, preservatives, colouring agents and like additives. The liquid formulation provides a vehicle for the removal of insoluble particulate matter and builders and suspending agents are often included in the compositions to facilitate this process. These prior art compositions are, to a greater or lesser extent, effective in removing soils, usually organic soils, from surfaces and in preventing their redeposition during the cleaning process. However, re-soiling of the surfaces after cleaning is an inevitable and continuous process.

Thus, domestic and other surfaces are continually dirtied or soiled by various means including, for example, soiling resulting from the preparation of food, contact by people and domestic pets, deposition of oily deposits and of airborne materials. Not only are these and like soils aesthetically displeasing, they may also have deleterious effects on health. The soils may contain allergenic material such as pollen, dust mites, dust mite droppings, cat and other animal allergens and furthermore may include harmful or toxic materials derived from adjacent or nearby industrial, horticultural or agricultural processes. Deposited soils may also harbour and give sustenance to pathogenic microorganisms or might include residues of human or animal faeces or urine. It is therefore important that these and like deposited soils are removed from surfaces efficiently and frequently.

Cleaning of surfaces is therefore a frequent and often time consuming requirement and is inevitably regarded as an unpleasant chore. There is a need for means to reduce the frequency of cleaning, and desirably also to facilitate the removal of soils deposited on surfaces. It will be appreciated that known, conventional, cleaning compositions have no effect on soils deposited on the surfaces after the cleaning process until such time as the cleaning process is undertaken again. The present invention therefore seeks to provide cleaning compositions which, after the cleaning process, are effective to reduce the required frequency of cleaning and/or to facilitate the removal of deposited soils.

It is an object of embodiments of the invention to provide a composition showing improved photocatalytic action.

In accordance with a first aspect of the present invention there is provided a liquid composition which in use is applied to a surface and dries to leave a residue, wherein the composition comprises in admixture (1) a photocatalytic material comprising up to 5% wt of the composition; or a precursor to a photocatalytic material, the photocatalytic material thereby produced comprising up to 5% wt of the composition;

(2) a sensitiser which acts to absorb visible or ultra violet or infra-red radiation and enhance the photocatalytic action of the photocatalytic material, the sensitiser comprising up to 1% wt of the composition.

It is an object of embodiments of the invention to provide a cleaning composition which, in addition to combating existing malodours and/or soils and/or undesired microorganisms when applied to a locus, for example a surface, combats further malodour compounds and/or soils and/or undesired microorganisms, after its application to a locus.

In accordance with a second aspect of the present invention there is provided a composition comprising a photocatalytic material able to combat malodours and/or soils and/or undesired microorganisms at a locus, or a precursor to such a photocatalytic material, a sensitiser which acts to absorb visible or ultra-violet or infra-red radiation and improve the efficacy of the photocatalytic material in combating malodours and/or soils and/or undesired microorganisms at the locus, and an alcohol; the photocatalytic material, sensitiser and alcohol being as defined herein.

By "combat" we mean that the composition of the second aspect can be used to remove and/or break down malodour compounds and/or soils and/or microorganisms at the locus and/or it can prevent malodours and/or soils and/or microorganisms from building up at the locus. The term "microorganism" is used in this specification to denote any microscopic organism which is combatted; but especially a bacterium. Also of interest, however, as microorganisms which are prospectively combatted by compositions of the invention, are viruses and fungi, in particular yeasts. One pathogenic microorganism which is of particular interest as demonstrating the efficacy of the compositions of the present invention is the bacterium *Staphylococcus aureus*.

Said composition of the second aspect includes deodorising compositions and anti-allergenic compositions. For example the compositions may have a deodorising effect, by breaking down odoriferous compounds, as deposits and/or as airborne compounds. For such uses the compositions may be applied to surfaces in the appropriate location or may be used in room sprays.

By means of the present invention a residue or layer of photocatalytic material can be provided at a locus, for example on a surface whereby soils and/or undesired microorganisms deposited on the residue or layer or soils or undesired microorganisms which are present on the surface prior to deposition of the residue or layer are subject to a photocatalytic or other photochemical oxidation, reduction, free radical or other photochemical reaction effective to break down, "burn away" or otherwise decompose the soils or undesired microorganisms or at least major components thereof; and/or to weaken their contact with the surface. Consequently it may be said that the cleaning process continues after the conventional act of removal of the soil or undesired microorganisms is completed.

As noted above soils may contain allergenic material which is decomposed or otherwise degraded by means of the present invention. Of particular interest is the use of the compositions of the invention in combating allergenic soils associated with house dust mites.

It is believed that the faeces of two particular house dust mite species, *Dermatophagoides farinae* (known as Der-f)

and *Dermatophagoides pteronyssinus* (known as Der-p) trigger the immune responses of the body, thereby giving rise to well known allergenic responses.

A review of this is given in Experimental and Applied Acarology, 10 (1991) p. 167–186 in an article entitled "House dust-mite allergen", a review by L. G. Arlian.

Both the Der-f and Der-p species are found throughout the world. In some areas, Der-f will be the sole Dermatophagoides species. In other areas Der-p will be the sole species. In still other areas, the two species are both present through, generally, one or the other will predominate.

Using the photocatalytic material, a decomposition reaction undergone by a malodour compound or a soil may involve photo-induced oxidation and/or photo-induced reduction reactions with organic or inorganic components of the malodour compound or soil. These reactions may in turn result in the production of free radicals which are effective in breaking down organic matter in the malodour compound or soil. These reactions may also provide an ongoing benefit after the initial deodorising or cleaning process has been completed.

A possible mode of action using the photocatalytic material is now described. Whilst we are not bound by any scientific theory, in this suggested mode of action, incident light of appropriate energy can promote an electron from a valence band of the photocatalytic material to a conductance band. There is then an electron ($e^-$) in the conductance band and a hole ($h^+$) in the valence band. Both the electron and the hole may migrate to the surface of the photocatalytic material particle and interact with oxygen and water to produce radical species. These radical species may then generate free radical decomposition reactions in the organic soil which may ultimately generate carbon dioxide if the free radical reaction continues to its conclusion. It is believed that the sensitiser is able to absorb light from the visible or ultra violet or infra-red (preferably the visible) region which causes an excitation of the sensitiser. Electrons are then emitted as the sensitiser decays or decomposes from the excited state, and these electrons are transferred to the conductance band of the photocatalytic material.

In this invention the "photocatalytic material" is peroxo modified titanium, preferably in its anatase form, or peroxo modified titanic acid, or a mixture therof, or a mixture of the above defined photocatalytic material and titania, preferably in its anatase form, or zinc oxide, or a combination of the two, and is preferably present in a total amount of from 0.01% to 20%, especially 0.2% to 3%, and most preferably 0.3 to 1%, by weight of the composition.

Photocatalytic material can be made by reference to the following

Journal of the Ceramic Society of Japan 104[8], 715–718 (1996) Synthesis of Peroxo-Modified Anatase Sol from Peroxo Titanic Acid Solution, by Hiromichi ICHINOSE, Makoto TERASAKI, Hiroaki KATSUKI.

Journal of the Ceramic Society of Japan 104[10] 914–917 (1996) Properties of Anatase Films for Photocatalyst from Peroxotitanic Acid Solution and Peroxo-Modified Anatase Sol, by Hiromichi ICHINOSE, Akihiko KAWAHARA, Hiroaki KATSUKI.

Preferably the photocatalytic material is imperceptible or almost imperceptible to the user after application. Preferably, the photocatalytic material used in the present invention is of a microscopic particle size. The microscopic particle size also assists in achieving a uniform dispersion throughout the formulation and in maximising the efficiency of the photocatalytic reaction. Suitably the photocatalytic material has a mean particle size (diameter) of at least 5 nm, preferably at least 10 nm, most preferably at least 15 nm. Suitably the photocatalytic material has a mean particle size of less than 200 nm, preferably less than 100 nm. One especially preferred class of photocatalytic material particles has a mean particle size in the range 5–100 nm, in particular 30–100 nm.

The photocatalytic material may be positively charged (from acidic stock solution) or negatively charged (from alkaline stock solution).

The photocatalytic material may be doped with an additional element which has the effect of reducing the energy required to promote an electron of the photocatalytic material to the conductance band, leaving the corresponding hole in the valence band.

Preferably, the sensitiser is present in an amount up to 1%, more preferably up to 0.1%, still more preferably up to 0.02%, and yet more preferably up to 0.01%. Preferably it is present in an amount from 0.00001%, more preferably from 0.0001%.

In this invention the sensitiser preferably absorbs radiation of wavelength which is in the band 200–1200 nm, preferably 400–800 nm. Its absorbency peak within these bands may be narrow. Thus, it may typically absorb within a sub-band 50–200 nm in width.

There are many sensitisers which will improve the efficacy of the photocatalytic material. Examples may include cationic, anionic, nonionic and amphoteric dyes. Cationic dyes are one preferred class. Examples include the cationic dye/anionic borate dye complex sensitisers described in U.S. Pat. No. 5,200,292. The cationic cyanine dyes disclosed in U.S. Pat. No. 3,495,987 are also believed to be useful in the present invention.

Other preferred sensitisers include the ruthenium sensitisers described in J. Am. Chem. Soc., Vol. 122, No. 12, 2000, pp. 2840–2849. These have three pairs of carboxylated bipyridyl groups complexed to a ruthenium (II) or ruthenium (III) atom. Two such complexes may be coupled together to make a polypyridine dyad, preferably an Ru(II)–Ru(III) polypyridine dyad.

Examples of preferred ruthenium sensitisers thus include the following compounds or salts thereof (conveniently halide salts, preferably chlorides):

ruthenium (III) bis-(4,4'-dicarboxyl-2,2'-bipyridine)-(1,2-bis[4-(4'-methyl-2,2'-bipyridyl)]ethane)-ruthenium(II) bis-(4,7-dimethyl-1,10-phenanthroline)

ruthenium (III) bis-(4,4'-dicarboxyl-2,2'-bipyridine)-(1,2-bis[4-(4'-methyl-2,2'-bipyridyl)]ethane)-ruthenium(II) bis-(2,2'-bipyridine)

ruthenium (II) bis-(4,4'-dicarboxyl-2,2'-bipyridine)-(4,4'-dimethyl-2,2'-bipyridine)

ruthenium (II) bis-(2,2'-bipyridine)-(4,4'-dimethyl-2,2'-bipyridine)

ruthenium (II) tris-(4,4'-dicarboxyl-2,2'-bipyridine)

ruthenium (II) tris-(2,2'-bipyridine)

ruthenium (II) bis-(4,4'-dicarboxyl-2,2'-bipyridine)

ruthenium (II) bis-(2,2'-bipyridine)

ruthenium (II) tris-(4,7-dimethyl-1,10-phenanthroline)

ruthenium (II) bis-(4,7-dimethyl-1,10-phenanthroline).

Other classes of sensitisers of interest for use with a photocatalytic material in the present invention the materials described in GB 1408144. They include eosin, rose bengal, fluorescein, chlorophyll, metal-free porphyrin, sulphonated phthalocyanine and sulphonated zinc phthalocyanine.

Other classes of sensitisers of interest for use with a photocatalytic material in the present invention include organosilicon (IV) phthalocyanines and naphthocyanines having Q-band absorption maxima at wavelengths greater than 660 nm. Further information on these sensitisers may be found in U.S. Pat. No. 5,916,481, the contents of which are incorporated herein by reference.

Further information about useful sensitisers is found in WO 98/32829. The sensitisers described therein could be used in the present invention, and the descriptions thereof are preferably incorporated herein by reference.

Preferably the composition includes a film-forming polymer. Suitable film-forming polymers include polyvinyl alcohol (PVA), polyvinyl pyrrollidone (PVP), novolac resins, resole resins and polyvinyl phenol resins. A preferred film-forming polymer is PVP or chemically modified PVP.

When a film-forming polymer is employed it suitably comprises at least 0.0005% wt of the composition, preferably at least 0.001% wt. It may typically comprise up to 1% wt of the composition, preferably up to 0.2% wt of the composition.

In a third aspect of the present invention there is also provided a composition which comprises in admixture (1) a photocatalytic material comprising up to 5% wt of the composition; or a precursor to a photocatalytic material, the photocatalytic material thereby produced comprising up to 5% wt of the composition;
(2) a sensitiser which acts to absorb visible or ultra violet or infra-red radiation and enhance the photocatalytic action of the photocatalytic material; and
(3) a humectant and/or hygroscopic compound.

Such compositions provide excellent deposition of the actives on the surface without smearing. It is believed that the humectant acts to attract water to the deposited composition thus facilitating the catalytic process.

Preferred humectants are monohydric and polyhydric alcohols as defined herein. Conversely, preferred monohydric and polyhydric alcohols for use in the first or second aspects herein are humectants and/or are hygroscopic.

Preferably the compositions additionally comprise an alcohol selected from;

(i) a monohydric alcohol, comprising at least 30% of the composition; or
(ii) a polyhydric alcohol, comprising up to 5% wt of the composition.

In preferred embodiments the composition may contain a monohydric alcohol in addition to a said polyhydric alcohol. In such embodiments the monohydric alcohol is suitably present in an amount of at least 0.1% wt, preferably at least 1% wt, and most preferably at least 2.5% wt, of the composition. In such embodiments the monohydric alcohol is preferably present in an amount up to 20% wt, more preferably up to 12% wt, and most preferably up to 8% wt, of the composition.

In embodiments in which at least 30% wt of a is monohydric alcohol is present the monohydric alcohol is preferably present in an amount up to 65% wt, more preferably up to 60% wt, of the composition. In such embodiments the monohydric alcohol preferably provides at least 35% wt of the composition. A polyhydric alcohol could be present in such embodiments—preferably in the amounts defined herein—but preferably is not present.

When any composition of the invention, whether it contains a polyhydric alcohol as the only alcohol or, as is preferred, also a monohydric alcohol, the polyhydric alcohol preferably comprises up to 3% wt of the composition, and more preferably up to 2% wt of the composition. Most preferably it comprises up to 1% wt of the composition. In such embodiments the polyhydric alcohol suitably provides at least 0.001% wt of the composition, and preferably at least 0.01% wt of the composition.

Preferably a monohydric alcohol used in the invention has from 1 to 8 carbon atoms, preferably from 1 to 6 carbon atoms. It may be linear or branched. Especially preferred are ethanol and isopropanol.

When a polyhydric alcohol is present in a composition of the invention it suitably has 2–4 hydroxyl groups, and 2–8 carbon atoms. Specially preferred are trihydric alcohols, preferably having 3–6 carbon atoms. Glycerol is especially preferred.

Although branched or, especially, linear alcohols are referred for use in the present invention cyclic alcohols are not excluded.

The compositions of the present invention are suitably provided in any appropriate wet form. They may be dispensed in conventional manner directly from a bottle or by means of, for example, a pump or a trigger spray or roller or an aerosol. Also, they could be applied to a surface by a brush, pad, impregnated woven or non-woven cloth, or sponge, paper towel, tissue paper or impregnated or non-impregnated wipe, pre-packed.

One or more components of the composition may be provided in one of the above, for example by being impregnated in an absorbent body, and other component or components may be provided in another of the above, for example in a trigger spray bottle.

According to another aspect of the present invention there is provided a kit for use in carrying out the method, the kit comprising at least two elements which together provide components (1), (2) and (3) defined above in the definition of the first or third aspect.

Liquid compositions are especially preferred, especially aqueous liquid compositions. Aqueous liquid compositions can be emulsions, including microemulsions, and/or may contain solvents which solubilise those sensitisers which do not dissolve in a water phase. Liquid compositions could be supplied ready-for-use or dilutable. Liquid compositions may be optically clear or opaque.

Whilst the person skilled in the art will be able to prepare aqueous and non-aqueous liquid formulations tailored to the above dispensing forms, the compositions of the present invention generally comprise not more than 99.7%, preferably 75% to 0.95% water, and cationic, anionic, nonionic or amphoteric surfactants, or compatible combinations thereof, in an amount of 0.05% to 80%, typically 0.5% to 10%. Surfactants should be selected having regard to the nature of the compositions in particular the photocatalytic agent or the precursor therefor, to ensure in-pack stability. In general, anionic surfactants are not suitable for incorporation in acidic compositions, especially those containing titania. In general cationic surfactants are not suitable for incorporation in alkaline compositions, especially those containing titania. Nonionic surfactants are especially preferred in compositions of the present invention.

Examples of nonionic surfactants which may be employed in the composition include those which are water soluble or water miscible and include but are not limited to one or more of the following: amine oxides, block copolymers, alkoxylated alkanolamides, alkoxylated alcohols, alkoxylated alkyl phenols, and sorbitan esters, for example sorbitan mono oleate. In each case the respective alkyl group is preferably a fatty alkyl group, suitably having from 7 to 24 carbon atoms, preferably 8 to 16, and may be branched or, more preferably, linear. Alkoxylate chains may be propoxylate chains, mixed ethoxylate/propoxylate chains or, most preferably, ethoxylate chains. Good examples include linear fatty alcohol ethoxylates (e.g. NEODOL, from Shell) and secondary fatty alcohol ethoxylates (e.g. TERGITOL, from Union Carbide). Other examples include alkoxylated octyl and nonyl phenols (e.g. IGEPAL, from Rhône-Poulenc).

Examples of cationic surfactants which may be used in the present invention include quaternary ammonium compounds and salts thereof, including quaternary ammonium compounds which also have germicidal activity and which may be characterized by the general structural formula:

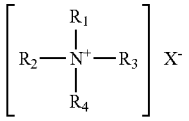

when at least one of $R_1$, $R_{21}$ $R_3$ and $R_4$ is a hydrophobic, aliphatic, aryl aliphatic or aliphatic aryl group containing from 6 to 26 carbon atoms, and the entire cationic portion of the molecule has a molecular weight of at least 165. The hydrophobic groups may be long-chain alkyl, long-chain alkoxy aryl, long-chain alkyl aryl, halogen-substituted long-chain alkyl aryl, long-chain alkyl phenoxy alkyl or aryl alkyl. The remaining groups on the nitrogen atoms, other than the hydrophobic radicals, are generally hydrocarbon groups usually containing a total of no more than 12 carbon atoms. The radicals $R_1$, $R_2$, $R_3$ and $R_4$ may be straight chain or may be branched, but are preferably straight chain, and may include one or more amide or ester linkages. The radical X may be any salt-forming anionic radical.

Examples of quaternary ammonium salts within the above description include the alkyl ammonium halides such as cetyl trimethyl ammonium bromide, alkyl aryl ammonium halides such as octadecyl dimethyl benzyl ammonium bromide, and N-alkyl pyridinium halides such as N-cetyl pyridinium bromide. Other suitable types of quaternary ammonium salts include those in which the molecule contains either amide or ester linkages, such as octyl phenoxy ethoxy ethyl dimethyl benzyl ammonium chloride and N-laurylcocoaminoformylmethyl)-pyridinium chloride. Other effective types of quaternary ammonium compounds which are useful as germicides includes those in which the hydrophobic radical is characterized by a substituted aromatic nucleus as in the case of lauryloxyphenyltrimethyl ammonium chloride, cetylaminophenyltrimethyl ammonium methosulphate, dodecylphenyltrimethyl ammonium methosulphate, dodecylphenyltrimethyl ammonium chloride and chlorinated dodecylphenyltrimethyl ammonium chloride.

Preferred quaternary ammonium compounds which act as germicides and which are useful in the present invention include those which have the structural formula:

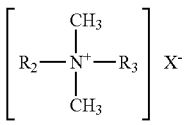

wherein $R_2$ and $R_3$ are the same or different $C_8$–$C_{12}$alkyl, or $R_2$ is $C_{12}$–$C_{16}$alkyl, $C_8$–$C_{18}$alkylethoxy, $C_8$–$C_{18}$alkylphenolethoxy and $R_2$ is benzyl, and X is a halide, for example chloride, bromide or iodide, or methosulphate. The alkyl groups $R_2$ and $R_3$ may be straight chain or branched, but are preferably substantially linear.

A mixture of two or more surface active agents may also be used. Other known surface active agents not particularised above may also be used in some compositions; especially when one of them is a nonionic surfactant. Surface active agents in general are described in McCutcheon's Detergents and Emulsifiers, North American Edition, 1982; Kirk-Othmer, Encyclopaedia of Chemical Technology, 3rd Ed., Vol. 22, pp 346–387.

Fluorosurfactants (FSOs) are preferred surfactants, especially fluorinated ethoxylated non-ionic sufactants.

Another preferred surfactant is a quaternary ammonium cationic surfactant, for example as sold under the trade mark REWOQUAT, available from Goldschmidt A G, defined as "fatty alcohols (ethoxylated) 40–60% concentration and quaternary ammonium compounds, coco alkyl-bis(hydroxyethyl) methyl, ethoxylated, chlorides (>20%)".

Preferred surfactants have a surface tension not exceeding 50 dynes/cm, preferably not exceeding 40 dynes/cm, and most preferably not exceeding 30 dynes/cm.

Grease cutting, adhesion promoting or other solvents may also be included generally in amounts of not more than 99%, typically not more than 50%, preferably not more than 12%, and most preferably not more than 8%, of the composition. Examples include glycols and glycol ethers.

Other ingredients of the compositions may include dispersing agents, suspending agents, colorants, fragrances, malodour combating agents (cyclodextrin, active fragrance components), surface active/coating polymers for sustained protection/coating of a surface, materials with mould and mildew or limescale removing properties (biocides, extreme pH materials), thickening reagents, polishes, sequestrants, fabric softening agents, optical brighteners, laundry anti-fade agents, enzymes, thickeners, preservatives, bleaches, bleach activators, waxes, stabilising agents, propellants and further material(s) to combat undesired microorganisms. In particular variations of liquid compositions of the invention, some or all of the ingredients may be of high volatility whereby a residue of photocatalytic material can be left behind on a surface in a controlled manner. The residue of the photocatalytic material should be well dispersed on the surface such that it is invisible or almost invisible to the naked eye.

Suitable dispersing agents may include hydroxyethyl cellulose, polyvinyl alcohol, polyvinyl acetate and ethylene oxide-propylene oxide block copolymers. Such agents may aid in-pack stability and promote good surface contact, on application.

Suitable adhesion promoters may include materials selected from polyvinyl alcohols, polyacrylic acids, ethylene oxide-propylene oxide block copolymers, hydroxyethyl celluloses, protein polymers and polysaccharide polymers. Preferred adhesion promoters may include polyvinyl alcohols, alginates, gum arabic, and pectin.

Liquid compositions of the invention, ready for use, may be of pH in the range 1 to 13, preferably 2 to 12, most preferably 3 to 11. Preferred compositions have pH values of 7 or more, and are more preferably alkaline. The pH is preferably 8 or more. Thus preferred liquid compositions of the invention, ready for use, are of pH in the range 8 to 13, preferably 8 to 12, most preferably 8 to 11.

The pH may not be the same as that of as-supplied liquid compositions, because the latter may be diluted.

In one embodiment the composition is a bleaching composition containing a peroxygen compound, for example hydrogen peroxide or a generator thereof, or peracetic acid or persuccinic acid.

The components of the composition should be selected, and/or the composition formulated, such that the composition is stable for a sufficient period, without components being degraded or rendered unstable by the photocatalytic material and the sensitiser. Preferably the compositions are packaged for sale in containers which shield the compositions from electromagnetic radiation of wavelength which would promote its photocatalytic action. All such measures are within the ordinary competence of persons skilled in the art.

Liquid compositions preferably have suitable rheology to suspend particles and/or to inhibit run off from upright surfaces, on application. To this end liquid compositions may be thixotropic, and preferably exhibit shear thinning with a suitable, preferably low, yield point.

Preferred compositions of the invention are colloidal suspensions of photocatalytic material particles.

Preferred colloidal suspensions of the photocatalytic material particles for use in the present invention are prepared by steps of hydrolysis of titanium tetrachloride in ammonium hydroxide, washing the precipitate thus formed, decreasing the pH to 3.3 by addition of a mineral acid, preferably nitric acid, washing until the conductivity drops below 500 μS, and peptisation by addition of a mineral acid, preferably nitric acid, either at room temperature for 7 days or at 60–70° C. for 30–90 minutes. The resultant colloidal suspension of the photocatalytic material typically has a photocatalytic material concentration of about 10 g/l and a mean particle size of about 20 nm. This method is known as the Woodhead method, after the inventor and patentee thereof.

Alternative colloidal suspensions of photocatalytic material particles for use in the present invention may be prepared by the "isopropoxide" method. This method involves the steps of hydrolysis of titanium isopropoxide, suitably in ammonium hydroxide, washing the precipitate thus formed, filtration, and peptisation by addition of a mineral acid, preferably nitric acid, either at room temperature for 7 days or at 60–70° C. for 30–90 minutes. The resultant colloidal suspension of photocatalytic material typically has a photocatalytic material concentration of 25–30 g/l and a mean particle size of about 20 nm, when the peptisation is at ambient temperature. When the peptisation is at the elevated temperature, the resultant colloidal suspension typically has a photocatalytic material concentration in excess of 100 g/l and a mean particle size of about 90–100 nm, but with a wide particle size distribution.

Further alternative colloidal suspensions of photocatalytic material particles for use in the present invention may be prepared by the Kormann method. In this method titanium tetrachloride is hydrolysed at 0° C. under a nitrogen blanket. Dialysis is carried out for 3–12 hours to remove undesired by-products of the hydrolysis. The resulting photocatalytic material suspension is dried using a rotary evaporator, aided by a water bath held at 30° C. The resulting solid is re-suspended in deionised water. No peptisation step is required. The resulting colloidal suspension of photocatalytic material typically has a photocatalytic material concentration of about 1 g/l and a mean particle size in the range 30–70 nm.

In accordance with a fourth aspect of the present invention there is provided a method of cleaning or sanitising a surface, the method comprising the steps of contacting the surface with the components defined above, preferably but not necessarily as one composition, but so as to deposit a residue of the photocatalytic material on the surface, and allowing the photocatalytic material to combat soils or undesired microorganisms present on or subsequently deposited on the surface.

In the case of soils the combating may be by catalysing or effecting an oxidation, reduction or other decomposition of the soils.

The method is suitably carried out with the surface and the composition at ambient temperature and without any subsequent-heat treatment.

The method is suitably carried out under visible light of intensity at least 5,000 lux. Preferably the method is carried out under ambient light conditions, for example daylight and/or under room lighting.

Acidic conditions may be favoured for methods of cleaning or sanitising bathrooms and lavatories.

Alkaline conditions may be favoured for methods of cleaning or sanitising laundry and kitchen environments.

Neutral or near-neutral conditions may be favoured for methods of treating delicate fabrics and surfaces (for example marble, and certain painted surfaces).

The skilled person may consult readily available zeta potential plots for chosen photocatalytic materials in order to ascertain available and optimal ranges of surfactants. Furthermore, the skilled person may use dispersing agents to allow co-formulation of materials which may otherwise be incompatible.

The colloidal and interfacial nature of the photocatalytic material will determine the nature of the sensitisers, surfactants and other materials which can be employed to good effect, having regard to in-pack stability, surface coverage and adhesion and photocatalytic activity. In the case of any doubt, of course, trial and error can be used. However, by way of guidance we can make the following general statements.

Preferred acidic photocatalytic material-containing compositions include a cationic and/or a nonionic surfactant; and preferably no anionic surfactant. A nonionic surfactant is in all cases a preferred constituent.

Preferred alkaline photocatalytic material-containing compositions include an anionic and/or a nonionic surfactant; and preferably no cationic surfactant (in contrast, with certain mildly alkaline compositions containing zinc oxide cationic surfactants may also be used). A nonionic surfactant is in all cases a preferred constituent.

Neutral or near-neutral compositions may contain a surfactant of any type, and preferably include a nonionic surfactant.

The surfaces treated in the method may be hard surfaces, for example surfaces of wooden objects, tiles, sanitaryware, painted objects, panels, kitchen surfaces, worktops, walls, floors, ceilings, roofs, windows, mirrors, shower cubicles and shower curtains, and cars. The hard surfaces may be the surfaces of outdoor garden structures, for example greenhouses, outdoor furniture, patios and paths, walls or house/garden surfaces, or roofing.

The surfaces treated in the method may be fibrous surfaces, for example clothes, furnishing fabrics and carpets.

As mentioned above and as is evidenced from the foregoing description and following examples our main interest is in providing a consumable surface cleaning composition which has, to paraphrase, a keep-clean or self-clean action. However, other compositions having a photocatalytic material or a precursor to the photocatalytic material and a sensitiser in admixture are included in the scope of the invention. Such compositions may, for example, be permanently secured to the surface of a substrate, for example of ceramic, glass or plastics. Securement may be by chemical bonding and/or a quasi-mechanical process, such as sputtering; or may be incorporated in an article, for example of ceramic, glass or plastics, during its manufacture. For example, the composition could be compounded with a plastics material prior to its moulding or extrusion. Also covered are compositions to be added to water, to sanitise and/or decolourise it and/or to combat soils and/or microorganisms on surfaces in contact with the water or to combat malodors.

The following examples are illustrative of compositions according to the invention in the form of a liquid. They may all contain sensitisers, colorants, fragrances and preservatives, preferably at concentrations not more than 1% each, with the balance of the formulations being photocatalytic material and water.

All percentages in this specification are expressed in weight of component per total weight of composition unless otherwise stated.

The invention will now be further described by way of example, with reference to the following non-limiting embodiments.

Unless otherwise stated the examples now described employ: polyvinylpyrrollidone, [PVP] herein, as film former; and the ethoxylated non-ionic fluorosurfactant ZONYL FS0 available from DuPont, [FSO] herein; the peroxo-modified titania product having the trade name HCT-3, from K. K. Haneron, 3-67 Wakabayashi, Yao shi, Osaka shi. The product contains peroxotitanic acid, in solution, and peroxo modified anatase in suspension, [Ti-peroxo] herein; or, for comparison purposes, a colloidal suspension of titania prepared by the Woodhead route described earlier, involving hydrolysis of titanium tetrachloride, acidification, washing and peptisation, [Ti-comp] herein. The concentration of titania in the resulting material, was about 10 g/l and mean particle size was about 20 mm.

The materials were diluted to a concentration of the titanium compound (in total if there is more than one) of 1 g/l for the experiments.

The sensitiser was dissolved in deionised water with the help of sonication, to make up a solution of concentration $3.5\times10^{-5}$M.

The preferred ruthenium sensitiser, [Ru-terpy] herein, was ruthenium (II) tris-(2,2'-bipyridyl) dichloride, having the CAS No. 97333-4-6-5, and the structure:

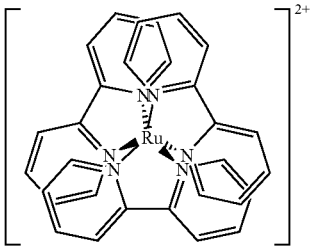

$C_{30}H_{24}N_6Ru$ Exact Mass: 570.11 Mol. Wt.: 569.62 C, 63.26; H, 4.25; N, 14.75; Ru, 17.74

Also used as sensitisers were:

ruthenium (II) bis-(4,7-dimethyl-10-phenanthroline) dichloride, [Ru-phen] herein, and ruthenium (II) bis-(2,2'-bipyridyl) dichloride [Ru-bipy] herein.

Compositions were prepared by blending the ingredients. In each composition the [PVP] concentration was 0.025% wt and the [FSO] concentration was 0.05% wt. Deionised water was the only additional component, to the materials described above.

Application to Glass

A non-woven kitchen cloth was immersed in the respective composition and squeezed until the weight of composition remaining was about twice the weight of the dry cloth. The cloth was then wiped across a vertical glass surface in a systematic manner, from top to bottom, then from one side to the other. The window was left to dry overnight. Fifteen panellists were then asked to assess the level of smearing obtained, on the following scale:

0—no smearing
1—slight smearing
2—moderate smearing
3—heavy smearing
4—excessive smearing.

Reference smear marks, at values 0 and 4, were present in the vicinity of the marks being assessed, to assist the panel members.

The average results are set out below.

[Ti-peroxo]+[Ru-bipy] composition—0.39
[Ti-peroxo]+[Ti-terpy] composition—0.22
[Ti-peroxo]+[Ru-phen] composition—0.17
[Ti-comp]+[Ru-bipy] composition—1.35
[Ti-comp]+[Ru-terpy] composition—1.19
[Ti-comp]+[Ru-phen] composition—1.89

Effectiveness Against Marks on Glass

Fingerprints were applied to glass by a volunteer, in the following manner. The volunteer rubbed his forefinger vigorously and repeatedly against his forehead, and then applied the finger to the glass eight times, in different places, to remove excess sebum from the finger. The volunteer then applied the finger to the portion of the glass previously coated with one of the compositions identified above, using the method described previously. The procedure was then repeated to obtain a fingerprint on a sample of the glass treated with a different composition, and so on.

Additionally, artificial sebum, obtained from Scientific Surfaces S/D Inc., of New York, USA, was applied to glass. 1 g of artificial sebum was melted in a 50 ml beaker on a hotplate. When the artificial sebum had fully melted the beaker was tilted and rotated, to coat the inside surfaces of the beaker. The artificial sebum was allowed to cool and solidify. A person wearing rubber gloves rubbed a finger over the internal side of the beaker and applied that finger to the glass eight times, in different places, to remove excess artificial sebum from the finger, and finally to a portion of the glass previously coated with one of the compositions identified above. The procedure was then repeated to obtain a mark on a sample of the glass treated with a different composition, and so on.

Assessment was again made by a panel using a 0–4 ranking, 4 being a very dirty mark applied to clean glass, unchanging with time, and 0 being glass of perfectly clean appearance. Such reference end-points were present in the vicinity of the marks being assessed, to assist the panel members.

Assessment was made by the panellists initially, when no degradation of the dirty mark could have taken place.

The results are stated below.

[Ti-peroxo]+[Ru-terpy] composition—artificial sebum print. Assessed level: 1.2

[Ti-peroxo]+[Ru-terpy] composition—fingerprint. Assessed level: 1.0

[Ti-peroxo] composition, no Ru sensitiser—artificial sebum print. Assessed level: 3.8

[Ti-peroxo] composition, no Ru sensitiser—fingerprint. Assessed level: 3.1

The invention claimed is:

1. A liquid composition which in use is applied to a surface and dries to leave a residue, wherein the composition comprises in admixture:

(1) a photocatalyic material selected from peroxo modified titania, peroxo modified titanic acid, a mixture of peroxo modified titania, peroxo modified titanic acid, a mixture of titania with one or both of peroxo modified titania and peroxo modified titanic acid, a mixture of zinc oxide with one or both of peroxo modified titania or peroxo modified titanic acid, and a mixture of titania and zinc oxide with one or both of peroxo modified titania and peroxo modified titanic acid;

(2) a sensitiser which acts to absorb visible or ultra violet or infra-red radiation and enhance the photocatalytic action of the said photocatalytic material, selected from:

(a) cationic dyes, anionic dyes, nonionic dyes, amphoteric dyes, ruthenium compounds having three pairs of carboxylated bipyridyl groups complexed to a ruthenium (II) or ruthenium (III) atom, eosin, rose bengal, fluorescein, chlorophyll, metal-free porphyrin, sulphonated phthalocyanine, sulphonated zinc phthalocyanine, organosilicon (IV) phthalocyanines and naphthocyanines having Q-band absorption maxima at wavelengths greater than 660 nm, as well as salt forms and mixtures thereof;

(b) one or more of the following compounds or salts thereof:

ruthenium (III) bis-(4,4'-dicarboxyl-2,2'-bipyridine)-(1,2-bis[4-(4'-methyl-2,2'-bipyridyl)]ethane)-ruthenium(II) bis-(4,7-dimethyl-1,10-phenanthroline;

ruthenium (III) bis-(4,4'-dicarboxyl-2,2'-bipyridine)-(1,2-bis[4-(4'-methyl-2,2'-bipyridyl)]ethane)-ruthenium(II) bis-(2,2'-bipyridine;

ruthenium (II) bis-(4,4'-dicarboxyl-2,2'-bipyridine)-(4,4'-dimethyl-2,2'-bipyridine);

ruthenium (II) bis-(2,2'-bipyridine)-(4,4'-dimethyl-2,2'-bipyridine);

ruthenium (II) tris-(4,4'-dicarboxyl-2,2'-bipyridine);

ruthenium (II) tris-(2,2'-bipyridine);

ruthenium (II) bis-(4,4'-dicarboxyl-2,2'-bipyridine);

ruthenium (II) bis-(2,2'-bipyridine);

ruthenium(II) tris-(4,7-dimethyl-1,10-phenanthroline);

ruthenium (II) bis-(4,7-dimethyl-1,10-phenanthroline); and, (4) a cationic, anionic, nonionic or amphoteric surfactant, or combination thereof.

2. A liquid composition according to claim 1, further comprising (3) a humectant, a hygroscopic agent or both.

3. A liquid composition according to claim 2, comprising an alcohol having 2–8 carbon atoms and 2–4 hydroxyl groups.

4. A liquid composition according to claim 2, comprising a trihydric linear alcohol having 3–6 carbon atoms.

5. A liquid composition according to claim 2, comprising glycerol.

6. A liquid composition according to claim 1, wherein the composition comprises a fluorinated surfactant.

7. A liquid composition according to claim 1 which further comprises one or more film forming polymers.

8. A liquid composition according to claim 7 comprising one or more film forming polymers selected from:

polyvinyl alcohol,
polyvinyl pyrrollidone,
novolac resins,
resole resins, and,
polyvinyl phenol resins.

9. A liquid composition according to claim 8 wherein the one or more film forming polymers are selected from: polyvinyl pyrrollidone or chemically modified polyvinyl pyrrollidone.

10. A liquid composition according to claim 1, wherein the composition is alkaline.

11. A liquid composition according to claim 1 which comprises:

(1) an anatase form of peroxo modified titania.

12. A liquid composition according to claim 1 wherein the sensitiser absorbs radiation which is in the band of 200–1200 nm.

13. A liquid composition according to claim 12 wherein the sensitiser absorbs radiation which is in the band of 400–800 nm.

14. A liquid composition according to claim 12 wherein the sensitiser absorbs radiation in a sub-band 50–200 nm in width within the band of 200–1200 nm.

15. A liquid composition for cleaning surfaces selected from ceramic tiles, sinks, baths, washbasins, toilets, work surfaces, ovens, hobs, carpets, fabrics, floors, painted woodwork, metalwork, laminates, glass surfaces according to claim 1.

16. A method of cleaning or sanitising a surface, comprising the steps of:

contacting the surface, with a liquid composition according to claim 1 to deposit a residue of the titanic material on the surface, and allowing the titanic material to combat soils or undesired microorganisms present on the surface or subsequently deposited on the surface.

* * * * *